US006113294A

United States Patent [19]

Niwa

[11] Patent Number: 6,113,294

[45] Date of Patent: Sep. 5, 2000

[54] TAPE PRINTER

[75] Inventor: Akihiko Niwa, Nagoya, Japan

[73] Assignee: Brother Kogyo Kabushiki Kaisha, Nagoyo, Japan

[21] Appl. No.: 09/281,213

[22] Filed: Mar. 30, 1999

[30] Foreign Application Priority Data

Mar. 31, 1998 [JP] Japan ..... P10-086465

[51] Int. Cl.[7] ..... B41J 11/70

[52] U.S. Cl. ..... 400/621; 400/613; 83/865; 83/881

[58] Field of Search ..... 400/621, 621.1, 400/621.2; 83/862, 865, 881, 861, 882, 883; 101/224, 226, 227

[56] References Cited

U.S. PATENT DOCUMENTS

| | | | |
|---|---|---|---|
| 5,066,152 | 11/1991 | Kuzuya et al. | 400/621 |
| 5,458,423 | 10/1995 | Sims et al. | 400/621 |
| 5,556,213 | 9/1996 | Kudo et al. | 400/621 |
| 5,605,087 | 2/1997 | Beadman | 83/881 |
| 5,676,478 | 10/1997 | Bowman et al. | 400/621 |

FOREIGN PATENT DOCUMENTS

| | | |
|---|---|---|
| 0 768 611 A2 | 4/1997 | European Pat. Off. . |
| 0 807 524 A2 | 11/1997 | European Pat. Off. . |
| 0 32849 62 | 12/1991 | Japan . |
| 6-71955 | 3/1994 | Japan . |

*Primary Examiner*—Christopher A. Bennett
*Attorney, Agent, or Firm*—Oliff & Berridge, PLC

[57] ABSTRACT

A head 18 and a cutting unit 23 are provided. The head 18 prints on a print layer of a laminated tape formed by laminating the print layer to a separation layer. The cutting unit 23 cuts the print tape transported from the head 18. A partial cutting unit B for cutting only the print layer and a full cutting unit A for completely cutting the tape are provided. A repetition print control means 47 and a first control means 48 are provided. The repetition print control means 47 controls the head 18 to print the same print content repeatedly for a plurality of times following the lengthwise direction of the print layer while sandwiching the print content between a non-printed areas having a predetermined width. The first control means 48 operates the partial cutting unit B to cut only the print layer in the non-printed areas formed before each print portion by the repetition print control means 47.

16 Claims, 12 Drawing Sheets

TAPE PRINTER

1. FIELD OF THE INVENTION

The present invention relates to a tape printer for printing on a print tape formed from a print layer and a separation layer in a laminated condition. The tape printer includes a full cutting unit for completely cutting the print tape and a partial cutting unit for cutting only the print layer of the print tape.

2. RELATED ART

Tape printers print on a print tape configured from a print layer and a separation layer. U.S. Pat. No. 5,458,423 discloses a tape printer with a full cut mechanism and a partial cut mechanism. The full cut mechanism includes a scissors-like configuration for completely cutting the print tape to form tape strips. The partial cut mechanism includes a confronting blade and anvil configuration for cutting only the print layer and retaining the separation layer.

The tape printer controls the partial cut mechanism to partially cut the print layer near the end of each tape strip. This forms a tab at the end of each tape strip to facilitate removal of the print layer (label) from the separation layer.

When the separation layer is to be removed to use the printed print layer as a label, the partial cut enables the user to easily remove the print layer from the position of the partial cut, by merely bending and deforming the tab. The print layer can be easily removed without troublesome use of fingernails or tweezers, and without problems, such as damaging the edge portion of the print layer.

The tape printer is provided with a disengagement lever for disabling the full cut mechanism. When a user desires to produce a continuous strip of labels, not entirely separated from one another, but each being removable individually from a common separation layer, the user disables the full cut mechanism using the disengagement lever. Since the full cut mechanism can not operate, the print tape will not be severed after each label is printed. When the user wishes to print tape to be cut to form a tape strip, the user returns the disengagement lever to its correct position.

SUMMARY OF THE INVENTION

Although U.S. Pat. No. 5,458,423 discloses configuration for forming a continuous strip of labels separated by partial cuts, the configuration has room for improvement.

For example, separate operations are required for inputting print data of different labels and for designating, by manipulating the disengagement lever, that different labels are to be printed on a continuous strip. Operations for printing continuous strips are therefore complicated. For example, the user can forget to operate the lever, so that the tape printer produces short tape strips when the user really desires continuous strips, and vice versa. It would be beneficial if the relationship between data input and designating the continuous strip printing were simplified.

Furthermore, the configuration requires a disengagement lever, which increases manufacturing costs of the tape printer, and also increases the number of components that can break. Assembly of the tape printer is also complicated by provision of the disengagement lever.

It is an objective of the present invention to overcome the above-described problems and provide a tape printer with a configuration for easily producing a continuous strip of labels separated by partial cuts.

In order to achieve the above-described objective, a tape printer according to the present invention is for printing tape strips from a tape configured from a print layer and a separation layer in a laminated condition. The tape printer includes a printing unit, a partial cut unit, a full cut unit, and a control unit.

The printing unit prints print areas in succession on the print layer following a lengthwise direction of the tape, while interposing non-print areas between adjacent print areas.

The partial cut unit cuts the print layer without cutting the separation layer and the full cut unit cuts both the separation layer and the print layer to form a tape strip.

The control unit controls the partial cut unit to cut the print layer in non-print areas. The control unit also controls the full cut unit to cut both the separation layer and the print layer each time the printing unit prints a designated number of printed areas.

With this configuration, the print tape is automatically cut by a full cut each designated number of print areas. Therefore, a plurality of labels are formed on a common separation layer having an easy-to-handle overall length. Labels can be more conveniently produced because the number of individual labels and also the number of tape strips, can be set.

Therefore, a variety of uses become possible, such as preparing a print tape that includes a plurality of labels having the same print content, such as the same name, with an overall length that matches an easy-to-handle length, or preparing ten labels that are numbered consecutively from 1 to 10. The variety of label uses can be further expanded.

According to a second aspect of the present invention, the tape printer includes a printing unit, a partial cutting unit, a repetitive printing control unit, and a cutting unit control unit.

In this case, the printing unit prints print areas on the print layer of the tape and the partial cutting unit that cuts only the print layer of the tape.

The repetitive printing control unit controls the printing unit to print the same print content repeatedly to form same-content printed areas in a lengthwise direction of the print layer. Adjacent same-content printed areas are separated by non-printed areas having a predetermined length in the lengthwise direction.

The cutting unit control unit operates the partial cutting unit to cut only the print layer in each non-printed area before one of the same-content printed areas formed by the repetitive printing control unit and the printing unit.

With this configuration, printed areas with the same content can be consecutively printed a plurality of times, with a partial cut formed in each non-printed area before each printed area. The tape printer is optimally suited for preparing great number of labels with the same name, or with the same wording or numbering, while easily eliminating unnecessary margin portions. The labels formed from the print layer can be easily removed from the separation layer at the partial cuts. Fewer unnecessary non-printed areas, such as margin portions, are formed.

Also, the user need not input the same text repeatedly even though the labels are to have the same content. That is, the repetitive printing control unit prepares a plurality of the same print content. This is convenient when forming labels having a plurality of general uses, such as "ENTRANCE" or "OIL FILLER PORT," or when forming a plurality of labels printed with a name indicating the owner of an object.

According to a third aspect of the present invention, the tape printer includes a printing unit, a partial cutting unit, a number printing control unit, and a cutting unit control unit.

The printing unit prints on the print layer of the tape and the partial cutting unit cuts only the print layer of the tape.

The number printing control unit controls the printing unit to print a plurality of number sets interposed with non-printed areas on the print layer following a lengthwise direction of the print layer, so that adjacent number sets differ from each other according to a particular algorithm, the non-printed areas having a predetermined length in the lengthwise direction.

The cutting unit control unit controls the partial cutting unit to cut only the print layer in each non-printed area before one of the number sets.

With this configuration, a plurality of number sets, each differing from each other according to a particular algorithm, are printed. Moreover, only the print layer is cut in non-printed areas formed before each number set. Therefore, a plurality of labels, each with different numbers, can be formed consecutively. The labels are formed from a print layer that can be easily removed from the separation layer using the partial cut. Fewer unnecessary non-printed areas, such as margin portions, are formed. The tape printer is convenient for producing numbered labels, labels for counting things, and the like, while easily eliminating unnecessary margin.

The number printing control unit can control the printing unit based on any type of algorithm. For example, an initial number can be incremented one at a time (i.e., 1, 2, 3), or additionally the resultant numbers can be multiplied by themselves (i.e., 1, 4, 9). It should be noted that each number set can consist of a single number, such as "1" or "5".

BRIEF DESCRIPTION OF THE DRAWINGS

The above and other objects, features and advantages of the invention will become more apparent from reading the following description of the preferred embodiment taken in connection with the accompanying drawings in which:

FIG. 8(*b*) is a cross-sectional view showing details of the blades while the partial cutting unit is in the condition of FIG. 7;

FIG. 15(*b*) is flowchart representing a numbering settings routine of the main routine;

FIG. 16(*b*) is flowchart representing a half cut settings routine of the main routine;

DETAILED DESCRIPTION OF THE PREFERRED EMBODIMENTS

Figure 1:
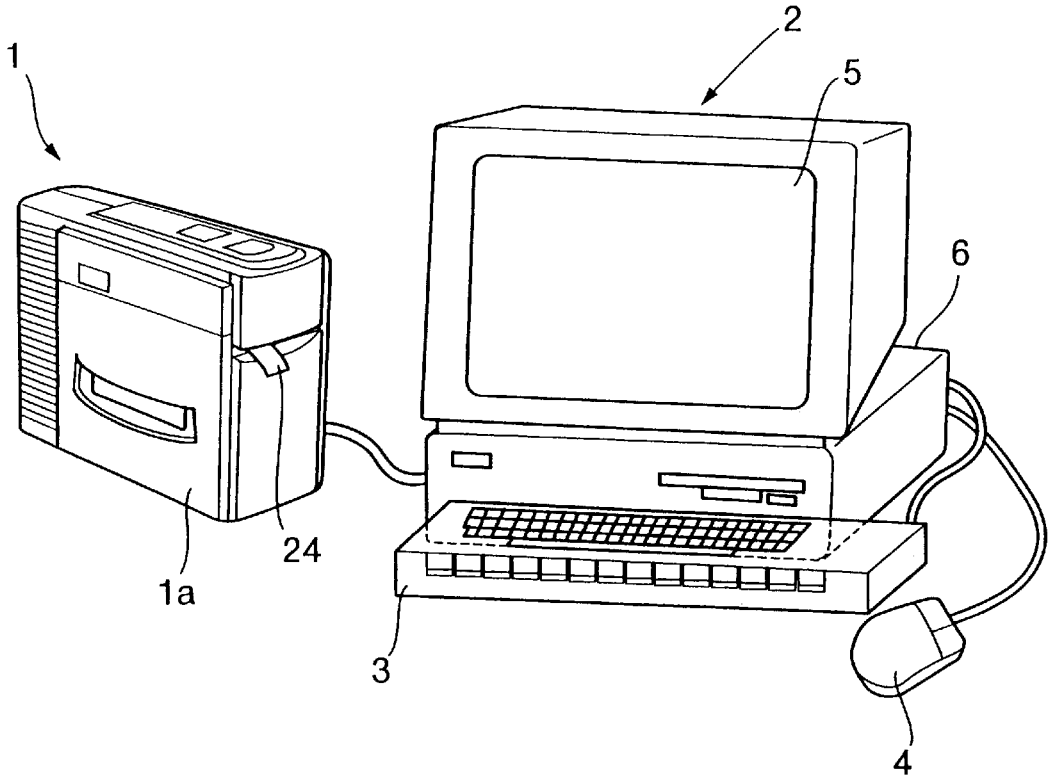
FIG. 1 is a view showing a tape printer and a data preparation device.

A tape printer 1 according to a preferred embodiment of the present invention will be described while ref erring to the accompanying drawings wherein like parts and components are designated by the same reference numerals to avoid duplicating description.

FIG. 1 is a perspective view showing the tape printer 1 connected to a data preparation device 2 for preparing text data and other types of data for printing. According to the embodiment, the tape printer 1 is controlled by the data preparation device 2. However, it should be noted that the control functions of the data preparation device 2 can be incorporated into the tape printer 1, and the data preparation device 2 dispensed with.

The data preparation device 2 includes a computer 6, connected by connection lines to a keyboard 3, a coordinate input device (mouse) 4, a CRT 5, and also the tape printer 1. The keyboard 3 includes input keys representing characters, numbers, and other symbols, cursor movement keys for moving a cursor upward, downward, leftward, and rightward across a display portion of the CRT 5, and a variety of other operations keys.

Next, a print mechanism in the tape printer 1 will be explained while referring to FIG. 2. The tape printer 1 has a case 1*a* housing a cassette housing portion frame 17, in which a tape housing cassette 7 is freely detachably mounted. A variety of components are freely rotatably provided in the tape housing cassette 7, such as a tape spool 9 wound with a transparent surface layer tape 8, which is formed from a transparent film such as polyethylene (PET); a ribbon supply spool 11 wound with an ink ribbon 10; a take-up spool 12 for taking up the ink ribbon 10; a base member supply spool 15 wound with a two-sided adhesive tape 13; and a coupling roller 16.

The two-sided adhesive tape 13 includes a base member, with adhesive layers on both surfaces, and a paper separation layer 14 attached to one of the adhesive layers. The two-sided adhesive tape 13 has the same width as the surface layer tape 8. The two-sided adhesive tape 13 is wound around the base member supply spool 15 so that the separation layer 14 faces outward. The coupling roller 16 is for coupling the two-sided adhesive tape 13 and the surface layer tape 8 together in a laminated condition. A tape feed motor 46 is provided for driving the tape spool 9 and the coupling roller 16.

A thermal head 18 is provided protruding upward from the cassette housing portion frame 17, at a position corresponding to an indentation 19 of the tape housing cassette 7. A roller holder 20 is pivotably provided on the cassette housing portion frame 17. A feed roller 22 is mounted at the free tip side of the roller holder 20 and a platen roller 21 is mounted nearer the pivot end of the roller holder 20. With this configuration, pivoting movement of the roller holder 20 presses the platen roller 21 toward the thermal head 18 and the feed roller 22 toward the coupling roller 16. The surface layer tape 8 and the ink ribbon 10 are supplied to pass in an overlapped condition between the thermal head 18 and the platen roller 21.

Figure 3:
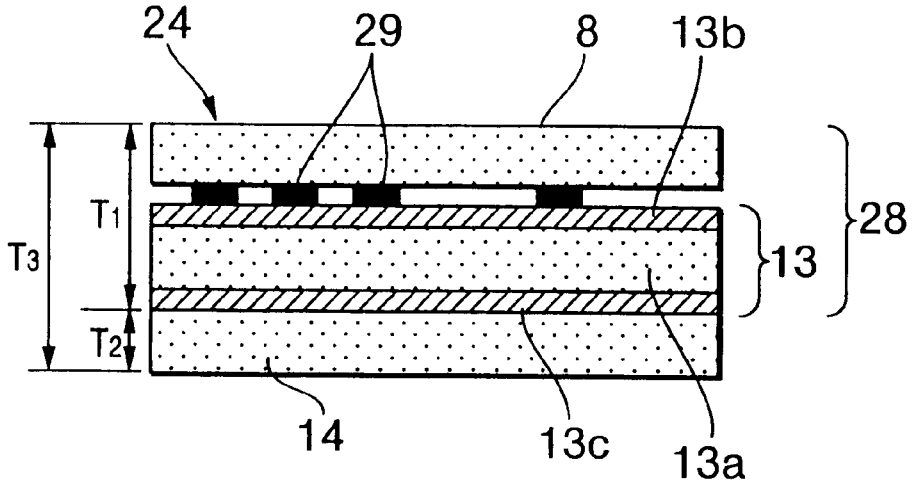
FIG. 3 is a magnified cross-sectional view of a tape.
Figure 4:
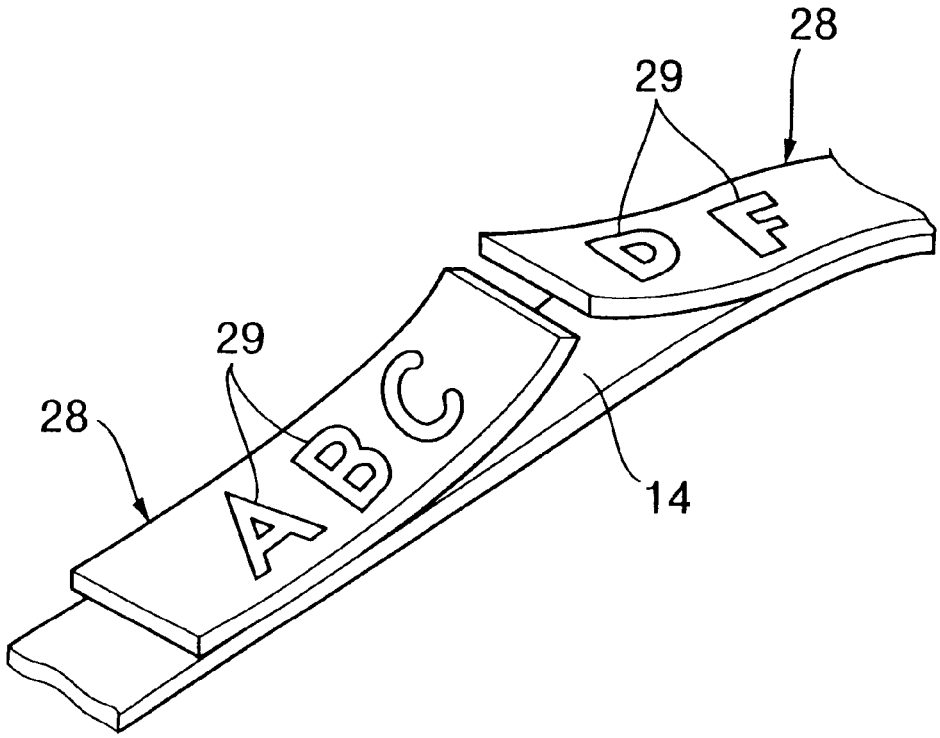
FIG. 4 is a perspective view showing a partial cross-sectional view of the tape.

When printing is performed based on print data prepared using the data preparation device 2, a drive motor 25 in the cassette housing portion frame 17 is rotated and the take-up spool 12, the feed roller 22, and the coupling roller 16 are rotated in synchronization using a gear mechanism (not shown in the drawings). At this time, thermal elements aligned in a row on the thermal head 18 are driven to be selectively energized. Ink on the ink ribbon 10 is melted and transferred onto the surface layer tape 8, so that as shown in FIG. 3, dot rows of ink 29 cling on the rear surface of the surface layer tape 8. Afterward, the two-sided adhesive tape 13 is laminated onto the print surface of the surface layer tape 8 to form a printed-on print tape 24, which is transported to a cutting unit 23.

FIG. 3 is a magnified cross-sectional view of a printed-on print tape 24. The printed-on print tape 24 includes the surface layer tape 8, the base tape member 13*a*, and the separation layer 14, all attached together by the adhesive layers 13*b*, 13*c* of the two-sided adhesive tape 13. A row of ink 29 dots forming mirror characters clings to the lower surface of the surface layer tape 8. The lower surface of the surface layer tape 8 is attached to the adhesive layer 13*b* formed on the base tape member 13*a*. The lower surface of the two-sided adhesive tape 13 is covered by the separation layer 14. The separation layer 14 is attached to the two-sided adhesive tape 13 by the adhesive layer 13*c* on the other surface of the base tape member 13*a*. The two-sided adhesive tape 13 and the surface layer tape 8, without the separation layer 14, configure label layers 28 having a thickness T1. The separation layer 14 has a thickness T2. The print tape 24 has a total thickness T3 (=T1+T2).

Figure 2:
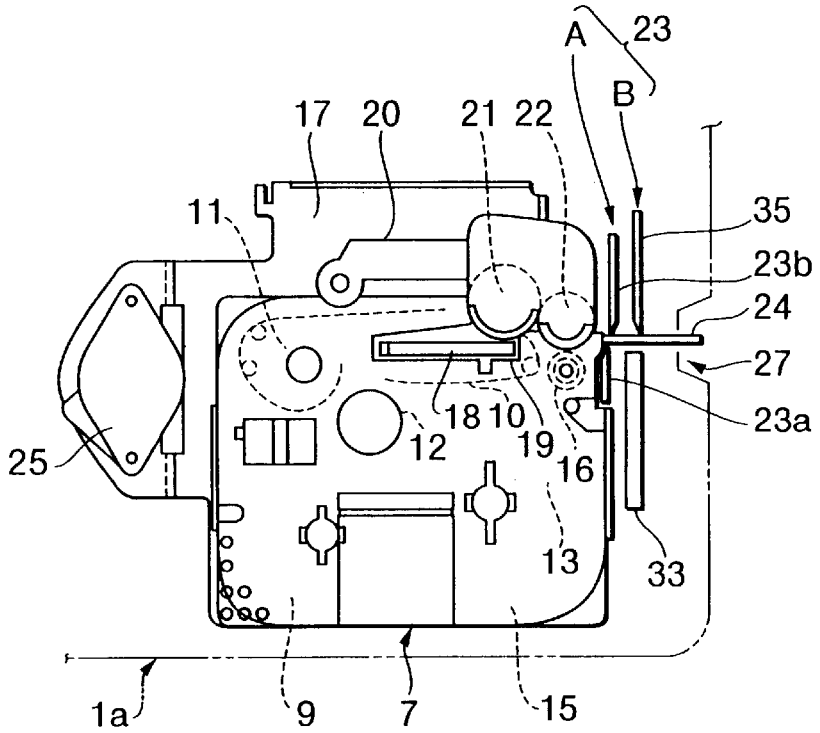
FIG. 2 is a plan view of a cassette housing portion.

As shown in FIG. 2, the cutting unit 23 is configured from a full cutting unit A for completely cutting through the entire print tape 24 and a partial cutting unit B for cutting all but the separation layer 14 of the print tape. The full cutting unit A has a scissors-like configuration formed from a fixed blade 23*a* and a movable blade 23*b*. The movable blade 23*b* is movable to approach toward and move away from the fixed blade 23*a* by pivoting movement. A power drive mechanism 26 shown in FIG. 9 drives the movable blade 23*b* to pivot and cut through the entire print tape 24.

Figure 5:
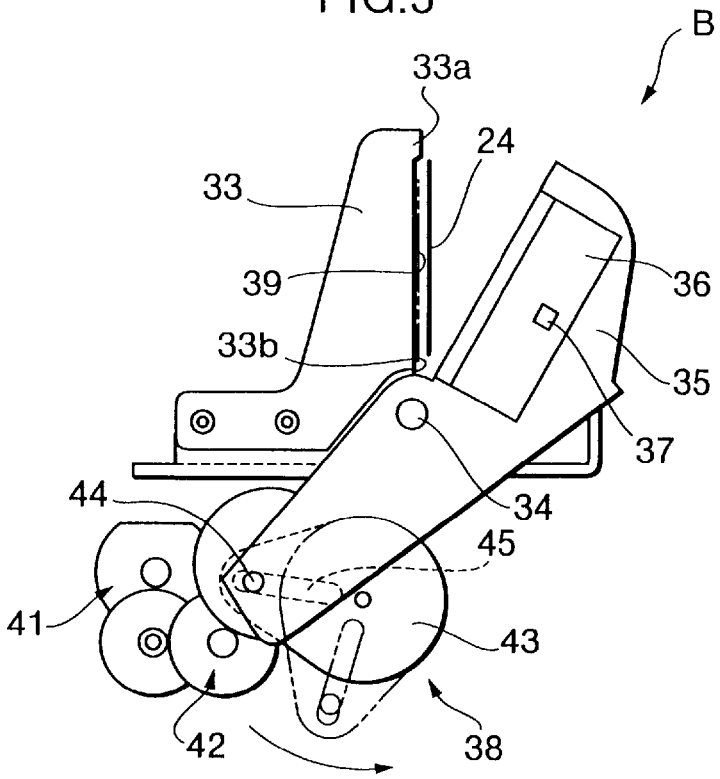
FIG. 5 is a plan view showing details of a partial cutting unit.
Figure 6:
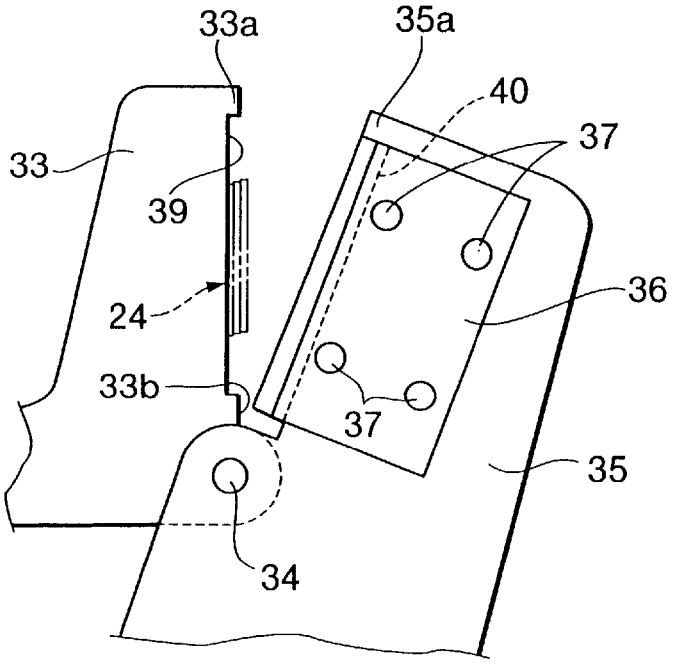
FIG. 6 is a magnified view showing details of the partial cutting unit of FIG. 5, while a movable blade of the partial cutting unit is pivoted open.
Figure 7:
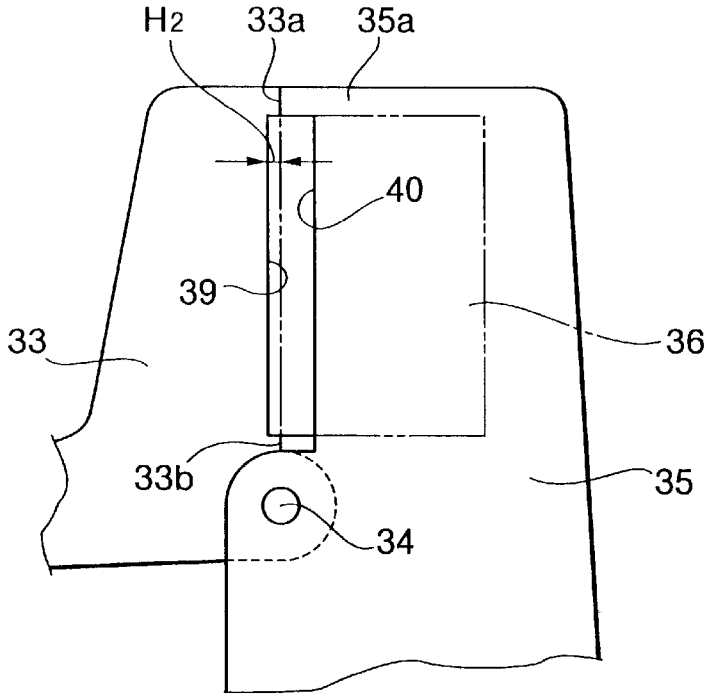
FIG. 7 is a magnified view showing details of the partial cutting unit of FIG. 5, while the movable blade is pivoted closed against a fixed blade.

The partial cutting unit B is disposed between the full cutting unit A and a sheet discharge portion 27 in the case la of the tape printer 1. As shown in FIGS. 5 to 7, the partial cutting unit B is configured from a fixed receiving stand 33, a support member 35 pivotable around a pivot pin 34 with respect to the receiving stand 33, and a drive unit 38 for driving pivoting movement of the support member. A cutting blade 36 is fixed by, for example, spot welding 37, to the support member 35.

The receiving stand 33 is manufactured from metal in a plate shape, and is fixed on the cassette housing portion frame 17 in the present embodiment. The receiving stand 33 is formed with a step 39, and a pair of step portions 33*a*, 33*b* at opposite sides of the step 39. In other words, one step portion 33*a* is formed near the tip end of the receiving stand 33 and the other step portion 33*b* is formed near the pivot pin 34. The surfaces of the step 39, and the step portions 33*a*, 33*b* facing the support member 35 are separated from each other by a distance H2, which is slightly smaller than the thickness T2 of the separation layer 14. Said differently, the step 39 is formed in to a depth H2 and the pair of step portions 33*a*, 33*b* are formed to height H2 with respect to the base surface of the step 39. Moreover, to ensure that the separation layer 14 is not cut, the step 39 has a width wider than the width dimension of the print tape 24, especially, the separation layer 14.

Figure 8:
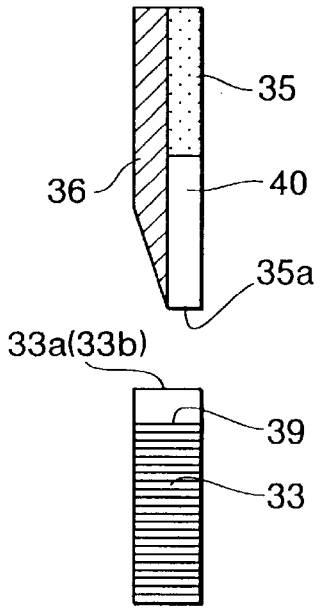
FIG. 8(*a*) is a cross-sectional view showing details of the blades while the partial cutting unit is in the condition of FIG. 6.
Figure 8:
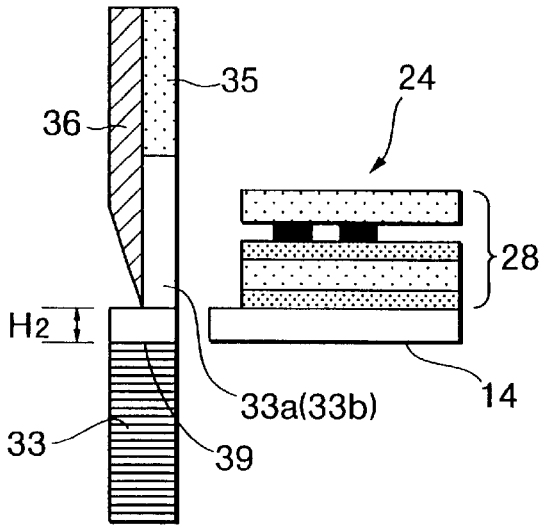

As shown in FIGS. 7, 8(*a*), and 8(*b*), the support member 35 is formed with a step 40 that extends between a leg portion 35*a*, which abuts a portion of one of the step portions 33*a*, 33*b*, and a location close to the pivot pin 34. As shown in FIG. 8(*b*), the step 40 has a depth greater than the total thickness T3 of the print tape 24, and moreover is wider than the width dimension of the print tape 24.

Here an explanation will be provided for operations to align and fix the cutting blade 36 onto the support member 35. First, the support member 35 is pivoted closed around the pivot pin 34 so that the leg portion 35*a* at the free end of the support member 35 abuts against the step portion 33*a* at the free end of the receiving stand 33. While the support member 35 is in this condition, the cutting blade 36 is mounted onto the support member so that both ends of the blade edge abut corresponding ones of the step portions 33*a*, 33*b*. The cutting blade 36 is then fixed to the support member 35 using spot welding 37, adhesive (not shown), or similar method. As a result, the blade edge of the cutting blade 36 extends parallel with the step 39 in the receiving stand 33. Furthermore, the space between the blade edge of the cutting blade 36 and the step 39 is equivalent to the height H2 of the step 39. With this method, it is extremely easy to fix the cutting blade 36 to the support member 35 without using any clasp. Moreover, attachment is much more precise.

The drive unit 38 is configured to pivot the support member 35, and consequently the cutting blade 36, in the counterclockwise direction as viewed in FIG. 5. As shown in FIG. 5, the drive unit 38 includes a drive motor 41 rotatable in forward and reverse directions, a gear train 42, and a crank 43. The crank 43 is provided at its tip with a pin 44. The pin 44 is slidably engaged in an elongated groove 45 of the support member 35. With this configuration, drive force of the drive motor 41 drives the crank 43 via the gear train 42 in the counterclockwise direction as viewed in FIG. 5. The support member 35 rotates in the counterclockwise direction accordingly. Although not shown in the drawings, the gear train 42 of the drive unit 38 is also provided with a slipping clutch for preventing excessive burden from being placed on the drive motor 41 after the leg portion 35*a* of the support member 35 abuts against the step portion 33*a* of the receiving stand 33.

According to the present embodiment, the partial cutting unit B is designed so that a partial cut of the print tape 24 is completed when at least the leg portion 35*a* of the support member 35 and one end portion of the blade edge of the cutting blade 36 abut against the step portion 33*a* of the receiving stand 33. However, the partial cutting unit B can be designed so that at the same time, the other end portion of the cutting blade 36 abuts against the other step portion 33*b* of the receiving stand 33. Although not shown in the drawings, a remit switch is provided to detect when the support member 35 is opened to a maximum angle. That is, the remit switch is provided at a suitable position to abut the support member 35 when the drive motor 41 is rotated in reverse to open the support member 35 to a maximum angle.

The remits switch outputs a predetermined signal accordingly, to stop the drive motor 41.

As the support member 35 and the cutting blade 36 are pivoted around the pivot center (pivot pin 34) and close against the receiving stand 33, the space between the blade edge of the cutting blade 36 and the step 39 becomes gradually narrower from the side near the pivot pin 34. Therefore, the blade edge of the cutting blade 36 gradually cuts the print tape 24 in a manner of a pair of scissors, starting from one edge of the print tape 24. Less power is needed compared to a pressing type cutter, wherein the blade edge of a cutting blade 36 cuts the tape across the entire width at once. The drive unit 38 can be more compact and the drive motor 41 can be formed from a small output motor.

In order to partially cut the print tape 24 so as to retain only the separation layer 14 uncut, partial cut operations are performed as shown in FIG. 8(*b*), that is, with the separation layer 14 positioned on the bottom surface of the step 39 of the receiving stand 33. In order to cut only the separation layer 14, partial cut operations are performed by placing the surface layer tape 8 on the bottom surface of the step 39 of the receiving stand 33.

Figure 9:
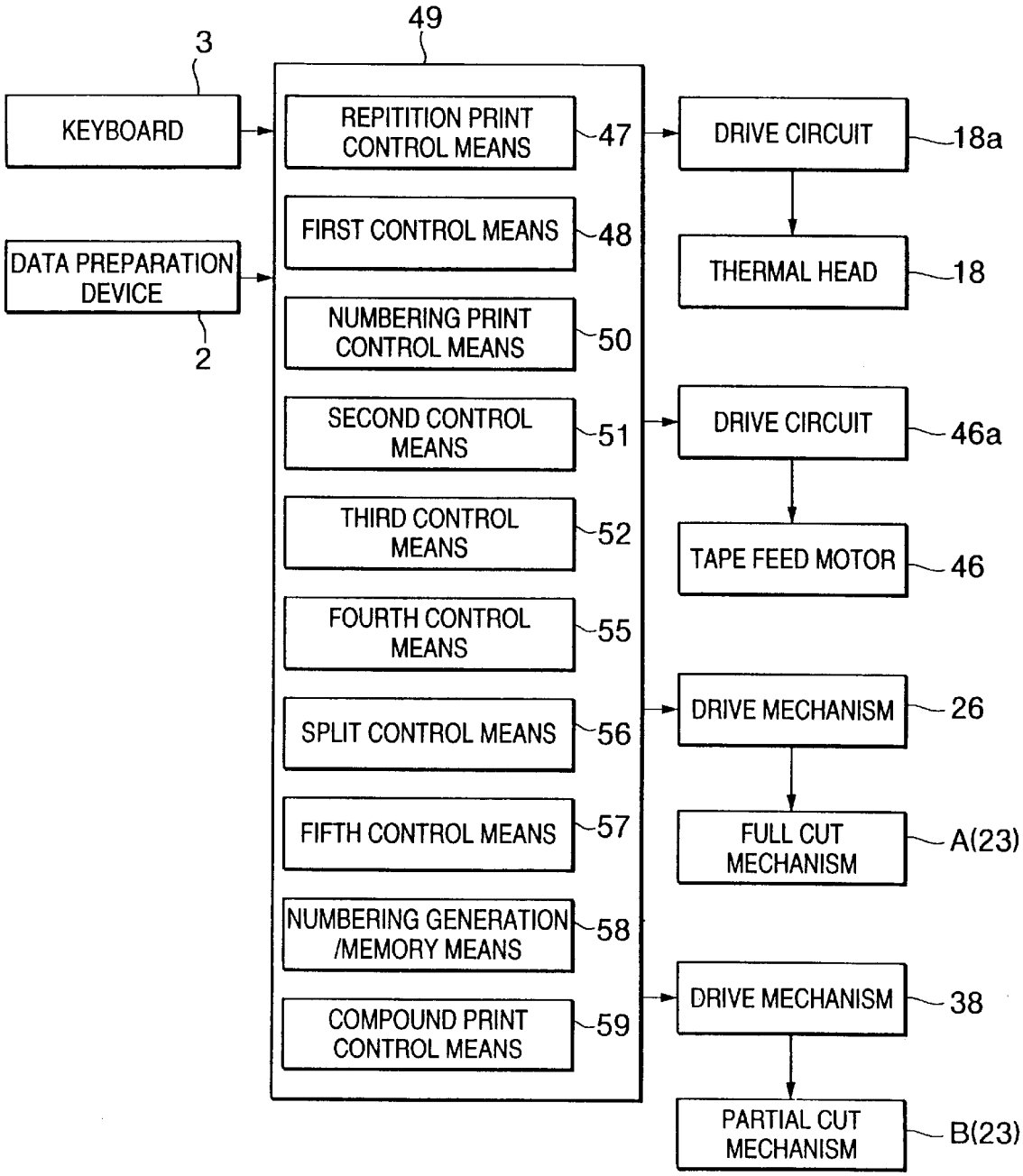
FIG. 9 is a block diagram of the tape printer.

The printer 1 includes a cutting control device 49 shown in FIG. 9. Although not shown in the drawings, the cutting control device 49 is configured from a well-known microcomputer including a CPU, a ROM storing a variety of programs and data, and a RAM for temporarily storing a variety of data. A variety of means 47–59 can be realized by the CPU executing the various programs stored in the ROM.

Figure 10:
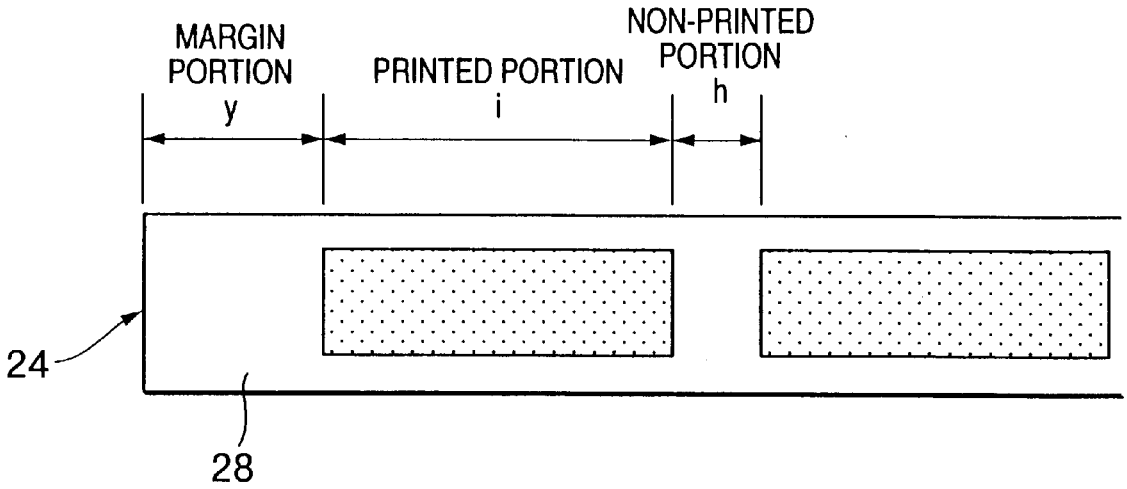
FIG. 10 is a view showing a margin portion, a print portion, and a non-printed area of a tape printed by the tape printer.

Here, operations of the different means 47–59 will be explained while referring to FIG. 10. A print tape 24 printed according to the means 47–59 includes a plurality of printed areas i with non-printed areas h interposed between adjacent printed areas i. A margin portion y, which is also a non-printed area, is formed at the end of the print tape 24 before a first printed area i.

For example, according to a repetition print control means 47, the thermal head 18 prints the same print content repeatedly on the surface layer tape 8 separated by a predetermined width to form a plurality of same-content printed areas i along the length of the resultant print tape 24, wherein non-printed areas h are interposed in between adjacent printed areas i. According to the first control means 48, the partial cutting unit B cuts the label layers 28 in the non-printed areas h or in the margin portion y, which are formed before printed areas i according to the repetition print control means 47.

According to a number printing control means 50, the thermal head 18 prints a plurality of numbered printed areas i following the lengthwise direction of the label layers 28, and interposes non-printed areas h between adjacent printed areas i. The numbered printed areas i change according to a particular algorithm. According to a second control means 51, the partial cutting unit B cuts only the label layers 28 in the margin portion y or the non-printed areas h, which are formed before printed areas i according to the repetition print control means 47.

According to a third control means 52, the thermal head 18, the partial cutting unit B, and the full cutting unit A operate together so that the entire print tape 24 is completely cut, instead of only the label layers 28, each predetermined number of print portions i. According to a fourth control means 55, the thermal head 18 and the partial cutting unit B operate together to cut only the label layers 28 between printed areas i and the margin portion y.

According to a split control means 56 print content to be printed by the thermal head 18 is split into sections in the height direction of the print content, and prints the split sections as printed areas i following the lengthwise direction of the tape. In this case also, adjacent printed areas i are separated by the non-printed areas h. According to a fifth control means 57, the split control means 56 and the partial cutting unit B operate together to cut only the label layers 28 in between adjacent printed areas i (split portions), and in between a first printed area i and the margin portion y formed before the first printed area i.

The partial cutting unit B is provided at a position to enable cutting the print tape 24 in association with completion of printing each printed area i. According to a numbering generation/memory means 58, count numbering data is generated and stored for each subject printed area i before the subject printed area i is printed. The count numbering data is different for each printed area i, changing according to a particular algorithm. According to a compound print control means 59, the count numbering data generated for the subject printed area i is combined with print data for the subject printed area i, to produce a set of compound data for printing in a blank portion of the tape. The print data represents any portion of the label to be printed other than the numbering. Examples of print data include data for printing text, frames, figures, and the like. The compound print control means 59 repeats this operation to produce numbered printed areas i with numbering that changes according to the particular algorithm.

Figure 11:
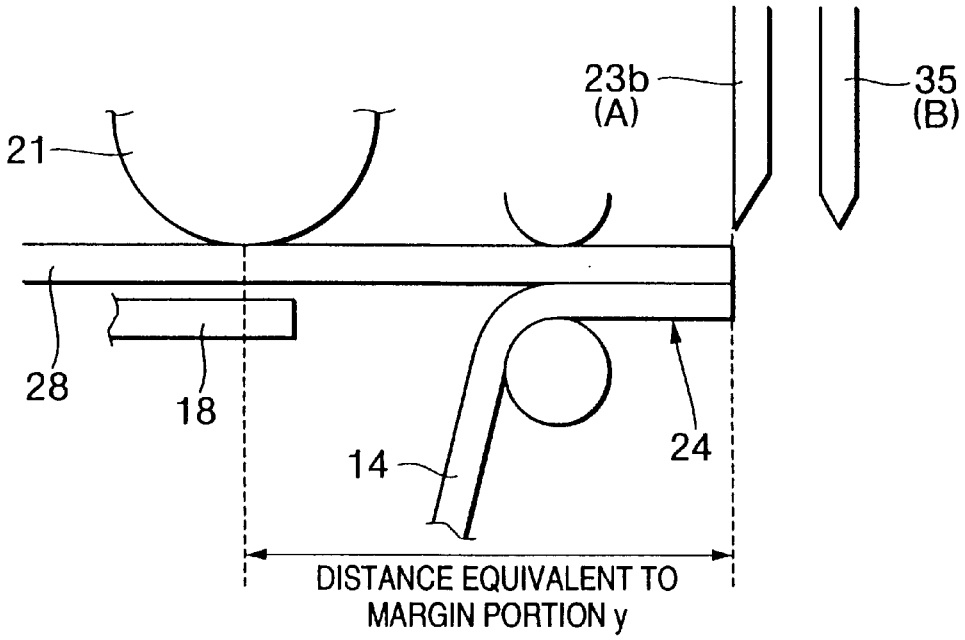
FIG. 11 is a side view showing positional relationship of the printing unit and the cutting unit.

As shown in FIG. 11, the thermal head 18 and the movable blade 23*b* of the full cutting unit A are separated by a distance in the tape feed direction equivalent to the margin portion y. After the print tape 24 has been subjected to a full cut operation, then as shown in FIG. 11, the tape end is positioned at the full cutting unit A. When the thermal head 18 is controlled to print at this time, a margin portion y is formed at the tape end before the printed area i. Also, a slight space exists between the movable blade 23*b* of the full cutting unit A and the support member 35 of the partial cutting unit B.

Figure 12:
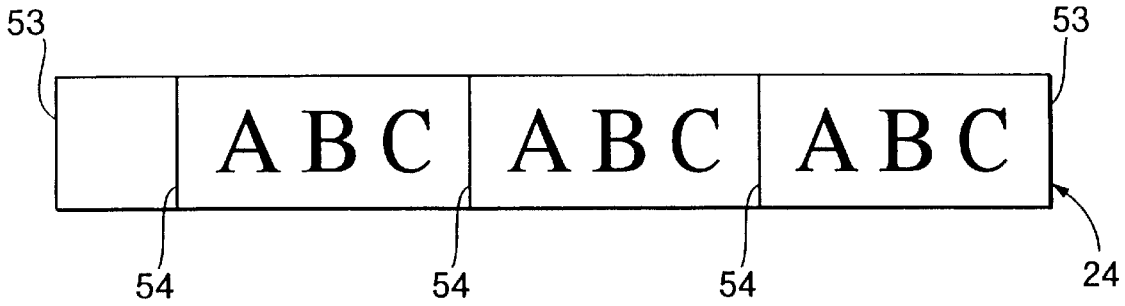
FIG. 12 is a schematic view of a type 1 tape.

FIG. 12 shows an example of a type I print tape 24 obtained by cooperative operation of the repetition print control means 47, the first control means 48, and the third control means 52. The type I print tape 24 of this example has a length determined by full cut lines 53 cut in the print tape 24 by the full cutting unit A. Three print portions, each having characters "ABC", are formed on the type I print tape 24 by printing the characters "ABC" three times on the print tape 24. Partial cut lines 54 are formed by the partial cutting unit B at a total of three locations at non-printed areas formed between the first print portion and the margin portion, and before the second and third print portions. By peeling the label layers 28 from the separation layer 14, three of the same labels printed with the characters "ABC" can be obtained.

Figure 13:
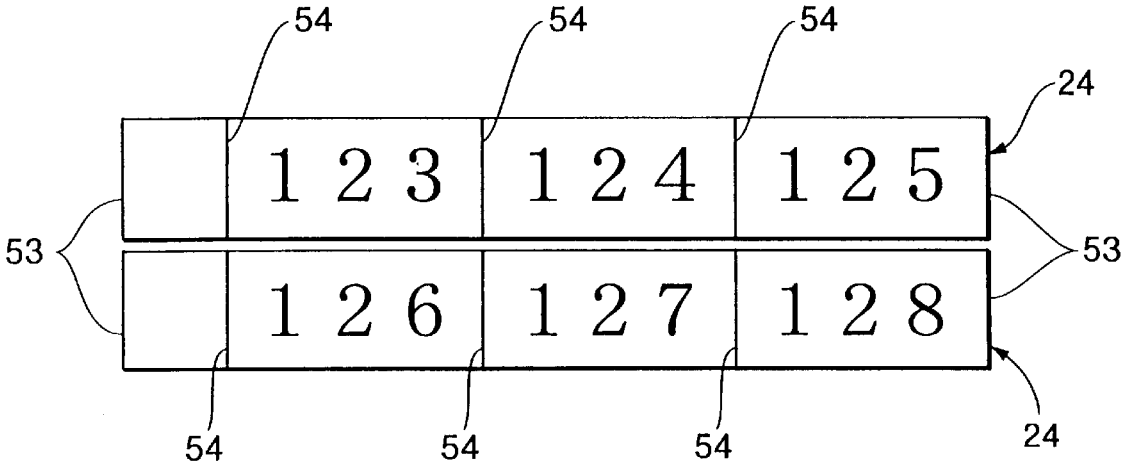
FIG. 13 is a schematic view of a type 2 tape.
Figure 14:
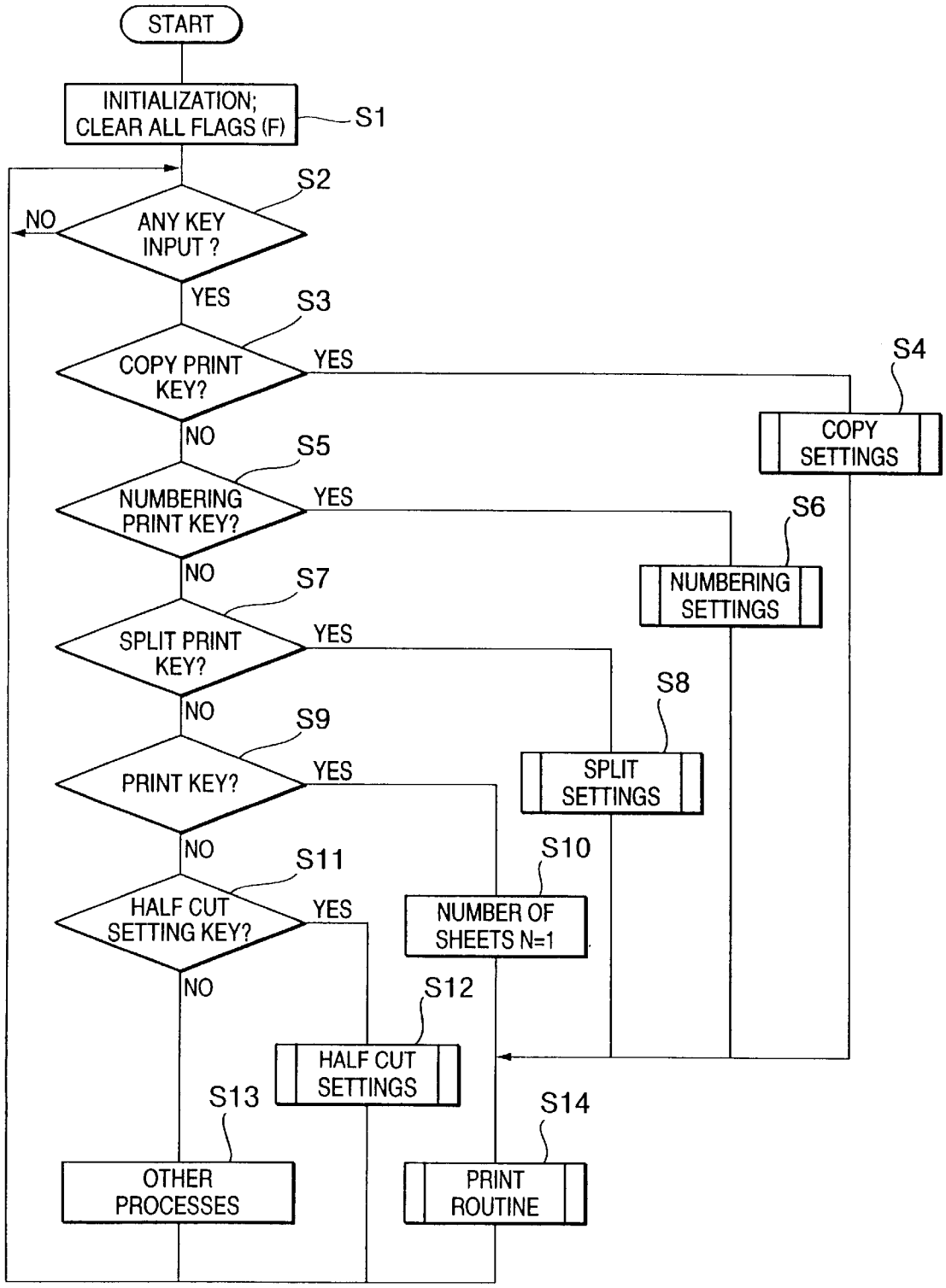
FIG. 14 is a flowchart representing a main routine of the embodiment.

FIG. 13 shows an example of two type II print tapes 24 obtained by cooperative operation of the number printing control means 50, the second control means 51, and the third control means 52. The type II print tapes 24 have three printed areas each, for a total of six printed areas. The six printed areas are divided by full and partial cuts 53, 54 to obtain six labels. Each printed area is printed with numbering that changes by increasing a three-digit number by one for each print portion.

Said differently, each type II print tape is provided with three locations for numbered print portions. Three non-printed areas are also formed, one before each print portion. (This includes the margin portion formed after the full cut and before the first print portion.) A partial cut line 54 is formed in each of the three non-printed areas. A full cut line 53 is formed after the third print portion. These operations are repeated twice to form two type II print tapes 24, each having a length determined by the full cut lines 53 at both edges. According to this, six labels can be obtained with consecutive numbering by peeling the label layers 28 from the separation layer 14.

Next, procedures for actually preparing a print tape using the tape printer 1 will be explained while referring to the flowcharts indicated in FIGS. 14 to 17. It should be noted that hereinafter Si (i=1, 2, 3 . . . ) are step numbers for each step in each flowchart.

First, the control device 49 performs initialization processes (S1) such as clearing all flags to update the values of the flags to zero. Then, input from a key is awaited (S2:NO). When there is key input by the user operating the keyboard 3 (S3:YES), then it is determined whether or not the operated key is the copy printing key (S3). If the operated key is the copy printing key (S3:YES), then a copy settings routine is performed (S4).

Figure 15A:
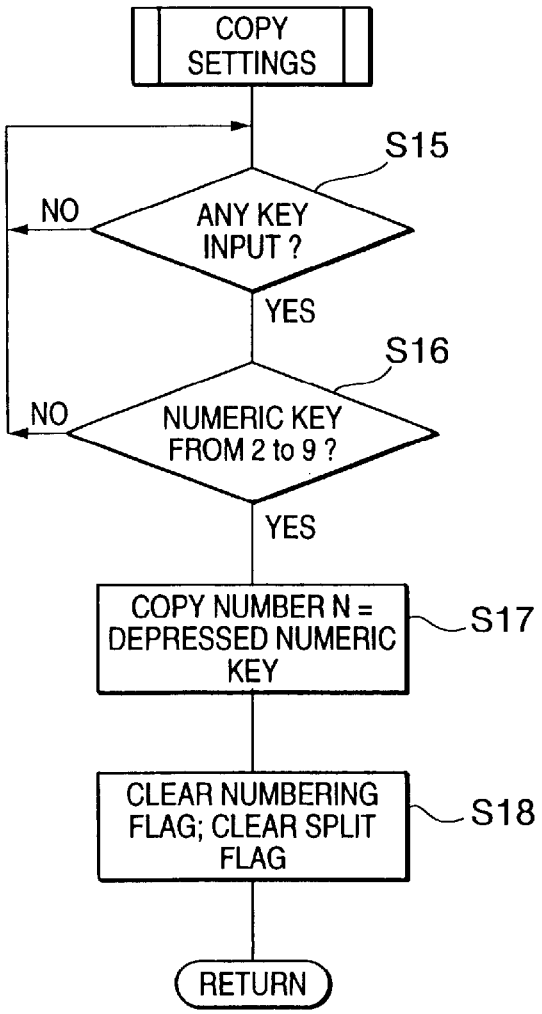
FIG. 15(*a*) is a flowchart representing a copy settings routine of the main routine.
Figure 15B:
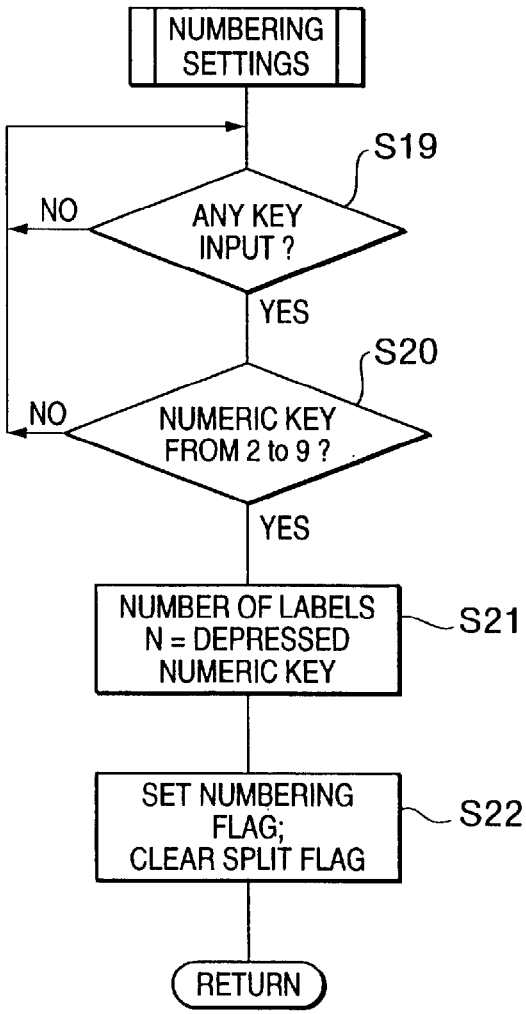

During the copy settings routine, the control device 49 first awaits key input (S15:NO) as shown in FIG. 15(*a*). That is, the control device 49 waits for the user to press a number key on the keyboard 3 to designate a number of copies to made of the same label. When the user designates the number of copies (S15:YES), then whether or not the inputted key is one of numeric keys 2 to 9 on the keyboard 3 (S16). If the input is from a key other than one of the numeric keys 2 to 9, for example, 1 or 0 (S16:NO), then it is judged that input was from an invalid key, and the routine returns to S15.

On the other hand, when input is received from any of the numeric keys 2 to 9 (S16:YES), then the number of the numeric key pressed by the user is stored in the RAM of the control device 49 as a total number of labels value N (S17). In this case, the total number of labels value N represents the number of copy labels to be produced. Then, a numbering flag F and a split flag F stored in the RAM are cleared (S18). After performing S18, the control device 49 returns to S14 of FIG. 14.

In S2, when the inputted key is the number printing key (S3:NO, S5:YES), then a numbering settings routine is performed (S6). In the numbering settings routine, the control device 49 first waits for key input as shown in FIG. 15(*b*). That is, the control device 49 waits for the user to press numeric keys on the keyboard 3 to input the number of numbered labels to be prepared. When there is key input (S19:YES), then it is judged whether or not the inputted key is any of the numeric keys 2 to 9. If input is from a key other than the numeric keys 2 to 9 (20:NO), then it is judged that the input was from an invalid key and the program returns to S19.

On the other hand, when input is from one of the numeric keys 2 to 9 (S20:YES), then the number of the numeric key pressed by the user is stored in the RAM in the control device 49 as the total number of labels value N. In this case, the total number of labels value N represents the number of numbered labels to be printed. Then, the numbering flag F is set and the split flag F is cleared (S22). It should be noted that when a flag is set, the flag value is updated to 1. After the control device 49 performs S18, the control device 49 returns to S14 of FIG. 14.

Figure 16A:
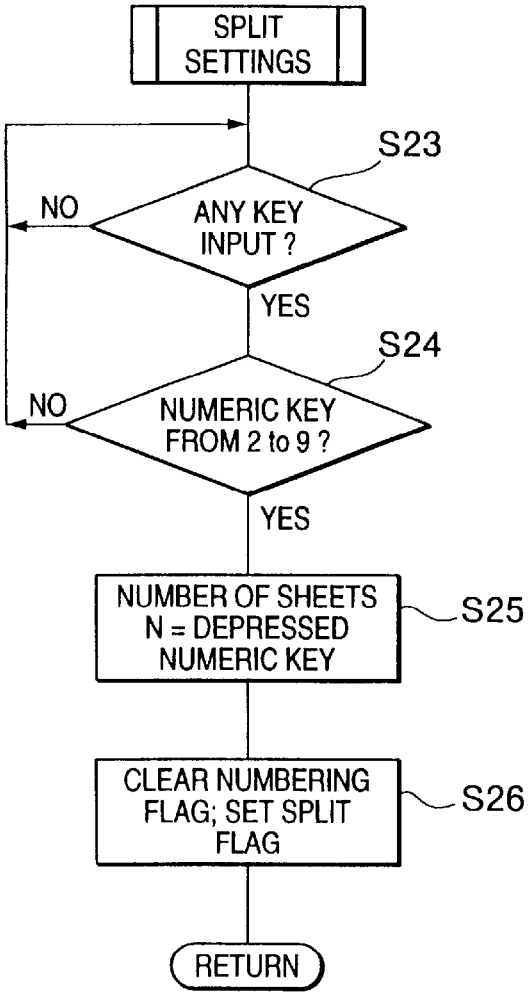
FIG. 16(*a*) is flowchart representing a split settings routine of the main routine.
Figure 16B:
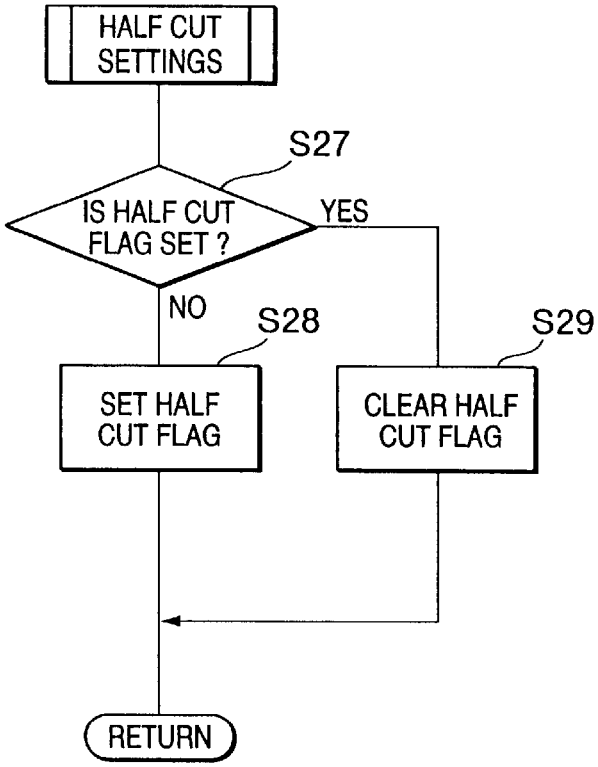

In S2, if the inputted key is the split print key (S3, 4:NO; S7:YES), then the split settings routine is performed (S8). As shown in FIG. 16(*a*), in the split settings routine, the control device 49 first awaits for key input (S23:NO). That is, the control device 49 waits for a user to press a numeric key of the keyboard 3 to input a number of times an image is to be divided when printed out. Since each divided section of the image is printed on a separate label, this value also represents the number of labels to be printed. When there is key input (S23:YES), it is judged whether or not the inputted key is one of the numeric keys 2 to 9 (S24). If input is from another key besides the numeric keys 2 to 9 (S24:NO), then it is judged that input is from an invalid key and the program returns to S23.

On the other hand, when input is from one of the numeric keys 2 to 9 (S24:YES), then the number of the numeric key pressed by the user is stored in the RAM of the control device 49 as the total number of labels value N. In this case, the total number of labels value N represents the number of times an image is to be split. Then, the numbering flag F stored in the RAM is cleared and the split flag F is set (S26). After the control device 49 performs S26, the control device 49 returns to S14 of FIG. 14.

In S2, if the inputted key is the print key (S3, 5, 7:NO, S9:YES), first the total number of labels value N is set to 1 (S10), and then a print routine to be described later is performed.

If in S2, the inputted key is a half cut setting key (S3, 5, 7, 9:NO, S11:YES), then a half cut settings routine is performed (S12). The user presses the half cut setting key when he or she wishes single labels to be provided with a half cut interposed between the printed area i and the margin portion y. As shown in FIG. 16(*b*), during the half cut settings routine, the control device 49 judges whether or not the half cut flag F stored in the RAM is in a set condition (S27). If the half cut flag F is already in the set condition (S27:NO), then the half cut flag F is cleared (S29). On the other hand, if the half cut flag F is not set but is in a clear condition, then the half cut flag F is set (S28). After performing either S28 or S29, the control device 49 returns to S2 of FIG. 14.

If during S2, the inputted key is not the half cut setting key (S3, 5, 7, 9, 11:NO), then the routine corresponding to the inputted key is performed (S13). Examples of routines performed in S13 include input and editing routines for text.

Figure 17:
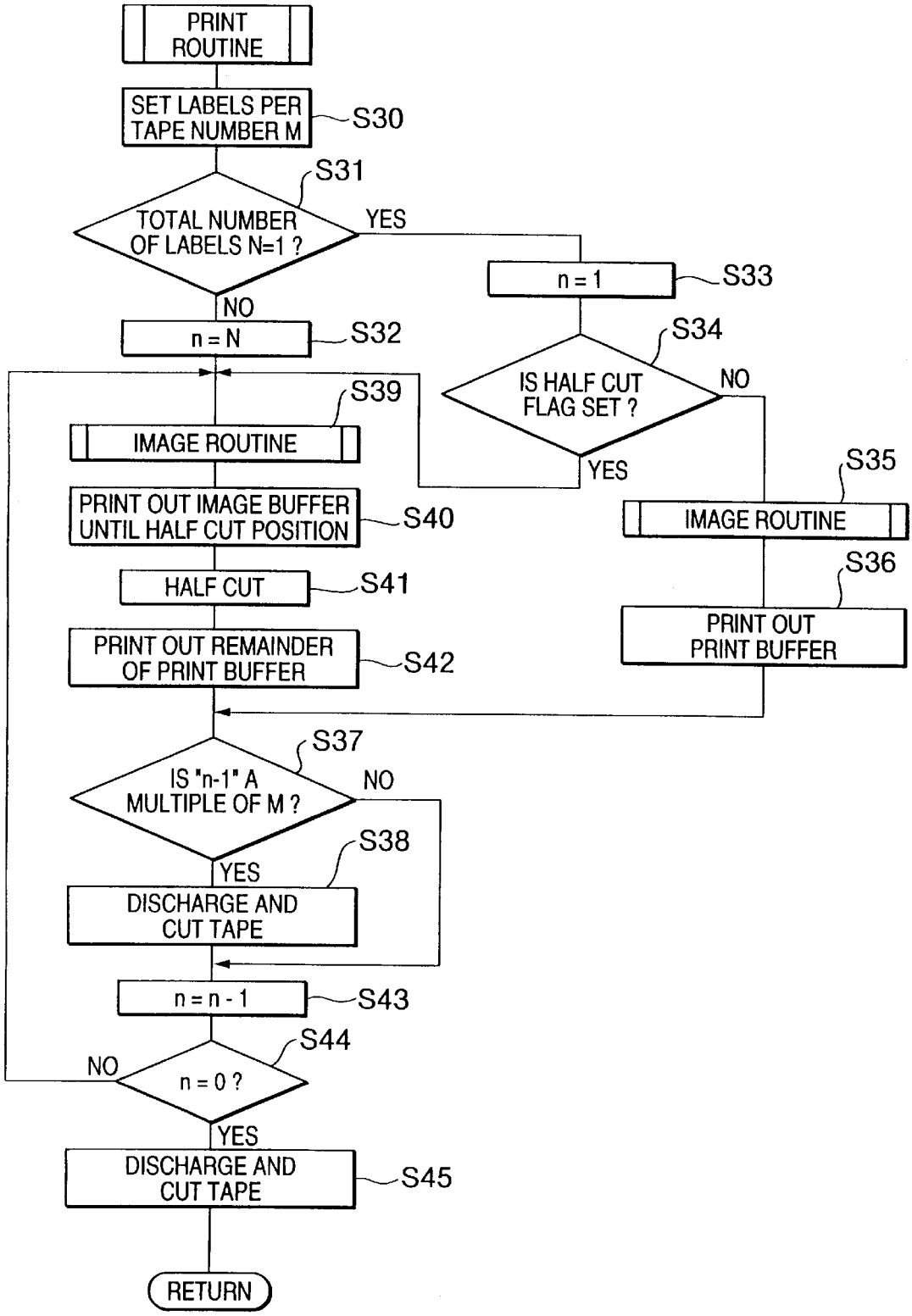
FIG. 17 is flowchart representing a print routine of the main routine.

Next, the print routine executed by depression of the print key will be explained based on the flowchart of FIG. 17.

The control device 49 sets the labels per tape number M (S30) and stores the number M in the RAM. In the present example, it will be assumed that the labels per tape number M is set to "3" so that three labels are to be printed on each tape strip, as indicated in the examples shown in FIGS. 12 and 13. The tape printer 1 can be configured so that the unit sheet number M is set automatically or optionally by input from the user using the keyboard.

Next, the control device 49 judges whether or not the total number of labels value N is one (S31). The total number of labels value N will only be one when the user wishes to print out a single label. That is, the total number of labels value N will not be one when the user has set copy printing, number printing, or split printing. When the user has set copy printing, number printing, or split printing (S31:NO), then the value of a present label indicator n provided in the RAM is set to equal the total number of labels value N (S32).

Figure 18:
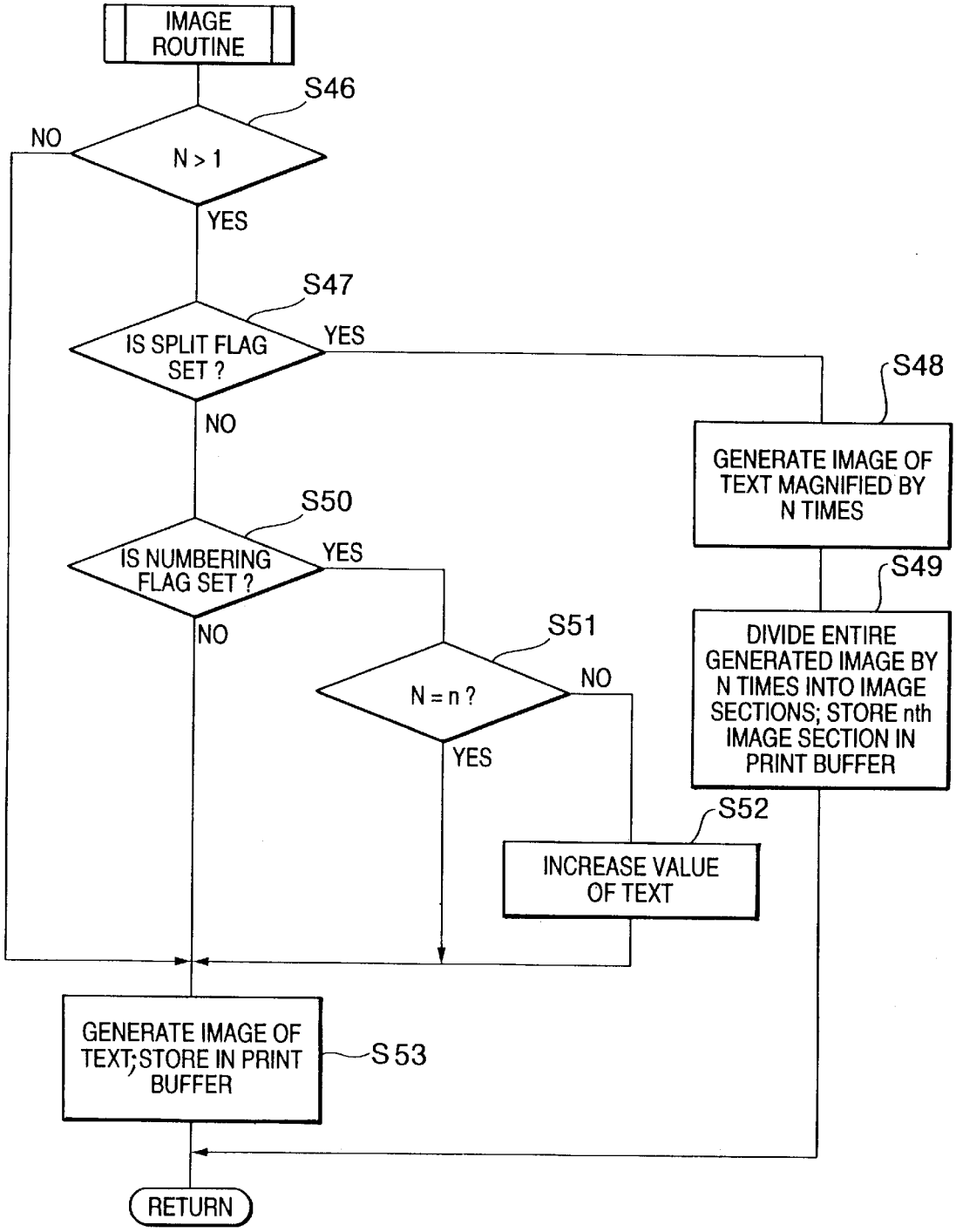
FIG. 18 is a flowchart representing an image routine of the print routine.

Next, based on text inputted, for example, from the data preparation device 2, an image routine is performed to prepare image data for printing out a label (S39). The image routine is represented by the flowchart in FIG. 18. First, the control device 49 judges whether or not the total number of labels value N is greater than 1 (S46). If the total number of labels value N is larger than 1 (S46:YES), then this means that the user has set one of copy printing, number printing, or split printing.

Therefore, it is first judged whether or not the split flag F is set (S47). If the split flag is set, which means that the user has set split printing (S47:YES), then a print image is generated by magnifying the inputted text by N times (S48). It should be noted that the "N times" used during image magnification is the division number, that is, the total number of labels value N, set in S25 of the split settings routine. Next, based on the total number of labels value N, the control device 49 divides the generated image N-times in the height direction into N number of image sections. Then, based on the present label indicator n, the control device 49 stores an nth number image section of the divided image in a print buffer of the RAM (S49). Then the program returns to S14 of FIG. 17.

On the other hand, when the user sets number printing, the numbering flag F is in a set condition (S50:YES). Therefore, the control device 49 judges whether or not the total number of labels value N matches the present label indicator n (S51). If they match (S51:YES), then this means that the first label of the plurality of numbered labels is to be printed in number printing. Therefore, print image data for inputted text data is prepared as is and stored in the print buffer (S53). Afterward, the routine returns to S14 of FIG. 17.

During S51, if the total number of labels value N and the present label indicator n do not match (S51:NO), then this means that a second or subsequent label is to be printed during number printing. Therefore, the value of the inputted text is increased (S52) according to a particular algorithm and the program returns to S53.

When the user sets copy printing, both the split flag F and the numbering flag F will be in a cleared condition. Therefore, the control device 49 makes a negative judgement in S37 and S50 and executes S53. After preparing print image data for the inputted text and storing the print image data in the print buffer, the program returns to S14 of FIG. 17.

When the image routine is finished, then in S40 the control device 49 drives the thermal head 18 and the tape feed motor 46 and prints the print image data stored in the print buffer, until a half cut position, that is, a position on the tape where a half cut is to be performed, is transported into alignment with the partial cutting unit B. Because the first label of a group of labels is presently being printed in this example, this half cut position is where the partial cut directly after the margin portion y is to be cut. When the half cut position is transported to the partial cutting unit B, drive of the thermal head 18 and the tape feed motor 46 is temporarily stopped and the partial cutting unit B is driven to perform a half cut (S41). The thermal head 18 and the tape feed motor 46 are again driven and the remaining image data for the first label, that is, the remaining data that was not printed during S40, is printed out (S42).

Next, the control device 49 determines the number of labels that remain unprinted, by subtracting one from the present label indicator n. Then, the control device 49 determines if the remaining number of labels is a multiple of the labels per tape number M set during S30 (S37). If the result is a multiple of the labels per tape number M (S37:YES), then a full cut operation is performed. In this case, the tape feed motor 46 is driven and the print tape is transported until the rear edge of the resultant print is transported to the place of the full cutting unit A, and then the full cutting unit A is driven to perform a full cut (S38). Then the present label indicator n is decremented by one, and the resultant value is set in the present label indicator n (S43). Then, it is determined whether or not the present label indicator n is zero (S44). If the present label indicator n is not zero, then this means that not all labels indicated by the total number of labels value N have been printed. Therefore, the control device 49 repeatedly executes S39 and following steps until the present label indicator n is decremented to zero in S43. Once the present label indicator n reaches zero, this means that all labels indicated by the total number of labels value N have been printed as desired by the user. Then, the tape feed motor 46 is driven in the same manner as in S38, until the rear edge of text of the lastly printed label is transported to the location of the full cutting unit A, whereupon the full cutting unit A is driven to perform a full cut (S45). Then, the program returns to S2 in FIG. 14.

On the other hand, in S37, when the number of labels left unprinted (i.e., n=1) is not a multiple of the labels per tape number M set in S30 (S37:NO), then S38 is skipped and S43 is executed.

When the user has not set copy printing, number printing, or split printing, this means that user only wants to print a single label, so that the total number of labels value N is set to one. Therefore, the control device 49 makes a positive determination in S31 and sets the present label indicator n to one (S33). The control device 49 determines whether or not the half cut flag F is set (S34). When the user wishes a half cut to be interposed between the printed area i and the margin portion y of single labels, and so has pressed the half cut key, so that the half cut flag F is set (S34:YES), then S39 and subsequent steps are executed. If the user has not pressed the half cut key, so the half cut flag F is in a clear condition (S34:NO), then the image routine is performed in the same manner as in S39 (S35). The thermal head 18 and the like are driven, and the surface layer tape 8 is printed on, based on print image data stored in the print buffer (S36). Then the routine proceeds to S37.

Here, operations performed to obtain the print tape 24 shown in FIG. 12 will be described. First, the user presses the input keys on the keyboard 3 to input text forming the character train "ABC" (S13). Next, the user presses the copy print key and the numeric key 3, to indicate that copy printing is to be performed and that the three copies of the inputted text is desired. As a result, during S17 of the copy settings routine (S4), the total number of labels value N is set to three. In S18, the numbering flag F and the split flag F are cleared.

Then, the user presses the print key. As a result, the print routine is executed and the labels per tape number M is set to three (S30). Because the total number of labels value N was set to three in S17 (S31:NO), then in S32, the present label indicator n is also set to three. During the image routine of S39, S46 results in a positive judgement, S47 and 50 result in negative judgements, whereupon S53 is executed. In S53, print image data of the character train "ABC" is prepared and stored in the print buffer. Then in S40 and S42, the character train "ABC" is printed, preceded by a half cut line 45. Because the first label has been printed out, in S37 it is determined that two labels remain unprinted by subtracting one from the present label indicator n (i.e., from 3). Because the two is not a multiple of the labels per tape number M (i.e., three), S39 to S44 are repeatedly executed until the present label indicator n reaches zero. By repeating these processes, a print tape 24 is formed with three labels, each printed with the character train "ABC" and separated from an adjacent label with a half cut line between the character trains "ABC". Then, a full cut is executed during S45 so that the user can obtain a print tape as shown in FIG. 12.

Next, operations performed to obtain the print tape 24 shown in FIG. 13 will be described. First, the user presses the numeric keys of the keyboard 3 to input the character train "123" (S13). Next, the user presses the number printing key and the number key 6, in order to set number printing and to set the number of labels to be printed to 6. As a result, the total number of labels value N is set to 6 during S21 of the number settings routine (S6) and the numbering flag F is set during S22.

Then the user presses the print key. As a result, the print routine (S14) is executed and the labels per tape number M is set to three (S30). Because the total number of labels value N is set to six (S31:NO), the present label indicator n is set to six in S32. During the image routine of S39, S46 results in a positive judgement, S47 results in a negative judgement, and S50 and S51 result in positive judgements. Then, S53 is executed, so that print image data for the character train "123" is prepared. By performing S40 to S42, the character train "123" is printed and a half cut line 54 is cut in the tape before the character train "123".

Because the number of remaining labels (i.e., the present label indicator n minus one, or 6−1=5) is not a multiple of the labels per tape number M (i.e., 3), S39 is again executed. During the second run of the image routine, S51 results in a negative judgement. During S52, the text character train "123" is increased to the character train "124." Then S53 is executed so that print image data is prepared for the character train "124". By performing S40 to S42, the character train "124" is printed and a half cut line 54 is cut in the tape before the character train "124".

The processes of S39 to S44 are repeatedly executed until the present label indicator n minus one is equal to a multiple of the labels per tape number M. Once the value of present label indicator n minus one reaches 3, and so is a multiple of the labels per tape number M, the tape is transported until the rear edge of the lastly printed character train (i.e., 125) reaches the full cutting unit A. Then, the full cutting unit A is driven to perform a full cut. As a result, a print tape 24 can be formed as shown in the upper half of FIG. 13, with the character train "123", the character train "124", and the character train "125," and with half cut lines 54 formed between adjacent character trains.

Because the present label indicator n is still not zero, S39 to S44 are repeatedly executed until the present label indicator n reaches zero. As a result, a print tape 24 as shown in the lower half of FIG. 13 is formed with the character train "126", the character train "127", and the character train "128," and with a half cut line 54 formed between adjacent character trains.

In this way, the user can obtain a print tape 24 formed with a half cut line 54 for each character train as indicated in FIGS. 12 and 13 merely by pressing the copy printing key and the number printing key to set copy printing and number printing.

It should be noted that even when split printing is performed, although resultant print is not shown in the drawings, the user merely presses the split print key to set split printing, to obtain a print tape 24 formed with divided sections of an image, and a half cut line 54 between adjacent divided sections.

While this invention has been described in conjunction with a specific embodiment thereof, it is evident that many alternatives, modifications and variations will be apparent to those skilled in the art. Accordingly, the preferred embodiments of the invention as set fourth herein are intended to be illustrative, not limiting. Various changes may be made without departing from the spirit and scope of the invention as defined by the following claims.

What is claimed is:

1. A tape printer for use with a tape having a print layer and a separation layer in laminated condition, the tape printer comprising:

a printing unit that prints print areas in succession on the print layer of the tape following a lengthwise direction of the tape, while interposing non-print areas between adjacent print areas;

a partial cut unit that cuts the print layer of the tape without cutting the separation layer of the tape;

a full cut unit that cuts both the separation layer and the print layer of the tape to form a tape strip; and a control unit that controls the partial cut unit to cut the print layer of the tape in non-print layers, and that controls the full cut unit to cut both the separation layer and the print layer in the tape each time the printing unit prints a designated number of print areas.

2. A tape printer as claimed in claim 1, wherein the control unit determines whether the printing unit has printed print areas successively in the designated number and, once the control unit determines that the printing unit has successively printed print areas in the designated number, controls the full cut unit to cut both the separation layer and the print layer.

3. A tape printer as claimed in claim 2, further comprising a number of print areas per tape strip designation unit that designates the designated number to represent a number of print areas to be printed on each tape strip.

4. A tape printer as claimed in claim 3, further comprising:

a total number of print areas designation unit that designates a total number of print areas to be printed in a single print operation;

wherein the control unit calculates a remaining number of the total number of print areas that remain unprinted, judges whether the remaining number is a multiple of the designated number, and controls the full cut unit to cut both the separation layer and the print layer of the tape when the remaining number is a multiple of the designated number.

5. A tape printer as claimed in claim 2, wherein:

the partial cut unit includes a first drive mechanism; and the full cut unit includes a second drive mechanism, separate from the first drive mechanism.

6. A tape printer as claimed in claim 1, wherein the control unit controls the printing unit to print the same print content in all print areas.

7. A tape printer as claimed in claim 1, wherein the control unit controls the printing unit to print different number sets in adjacent print areas, the different number sets differing from each other according to a particular algorithm.

8. A tape printer as claimed in claim 1, wherein the control unit generates an image, divides the image into image sections in a number equal to the designated number, and controls the printing unit to print the print areas in succession based on the image sections.

9. A tape printer as claimed in claim 1, where the partial cut unit includes a scissors-like configuration for cutting only the print layer without cutting the separation layer.

10. A tape printer as claimed in claim 1, wherein:

the partial cut unit includes a first drive mechanism; and the full cut unit includes a second drive mechanism, separate from the first drive mechanism.

11. A tape printer for use with a tape having a print layer and a separation layer in a laminated condition, the tape printer comprising:

a printing unit that prints print areas on the print layer of the tape;

a partial cutting unit that cuts only the print layer of the tape;

a repetitive printing control unit that controls the printing unit to print, in a lengthwise direction of the print layer of the tape, the same print content repeatedly to form same-content printed areas interposed with non-printed areas on the print layer of the tape, the non-printed areas having a predetermined length in the lengthwise direction;

a cutting unit control unit that operates the partial cutting unit to cut only the print layer of the tape in each non-printed area before one of the same-content printed areas formed by the repetitive printing control unit and the printing unit; and an input unit that inputs the same print content and a repetition number, the repetition printing control unit controlling the printing unit to print the same print content a plurality of times indicated by the repetition unit.

12. A tape printer as claimed in claim 11, further comprising:

a full cutting unit that completely cuts the tape; and a control unit that interlockingly operates the printing unit, the partial cutting unit, and the full cutting unit to cut both the separation layer and the print layer, instead of only the print layer of the tape, each time a designated number of same content print areas is printed.

13. A tape printer for use with a tape having a print layer and a separation layer in a laminated condition, the tape printer comprising:

a printing unit that prints on the print layer of the tape;

a partial cutting unit that cuts only the print layer of the tape;

a number printing control unit that controls the printing unit to print a plurality of number sets interposed with non-printed areas on the print layer of the tape following a lengthwise direction of the print layer of the tape, so that adjacent number sets differ from each other according to a particular algorithm, the non-printed areas having a predetermined length in the lengthwise direction; and a cutting unit control unit that controls the partial cutting unit to cut only the print layer of the tape in each non-printed area before one of the number sets.

14. A tape printer as claimed in claim 13, further comprising:

a full cutting unit that completely cuts the tape; and a control unit that interlockingly operates the printing unit, the partial cutting unit, and the full cutting unit to cut both the separation layer and the print layer, instead of only the print layer of the tape, each time a designated number of number sets is printed.

15. A tape printer as claimed in claim 13, further comprising:

an input unit that inputs an initial number and a total number of number sets, the number printing control unit controlling the printing unit to print the plurality of number sets according to the algorithm and the total number of number sets from the input unit.

16. A tape printer as claimed in claim 13, wherein the number printing control unit calculates the adjacent number sets based on the particular algorithm, and controls the printing unit accordingly.

* * * * *